US008235550B2

(12) United States Patent
Kong et al.

(10) Patent No.: US 8,235,550 B2
(45) Date of Patent: Aug. 7, 2012

(54) STREET LAMP

(75) Inventors: Kyung-Il Kong, Seoul (KR); Han Gyoul Kim, Seoul (KR); Kwang Soo Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 12/915,782

(22) Filed: Oct. 29, 2010

(65) Prior Publication Data

US 2011/0222284 A1 Sep. 15, 2011

(30) Foreign Application Priority Data

| | | |
|---|---|---|
| Jul. 7, 2010 | (KR) | 10-2010-0065215 |
| Jul. 7, 2010 | (KR) | 10-2010-0065216 |
| Jul. 7, 2010 | (KR) | 10-2010-0065218 |
| Jul. 9, 2010 | (KR) | 10-2010-0066139 |
| Jul. 9, 2010 | (KR) | 10-2010-0066141 |
| Jul. 9, 2010 | (KR) | 10-2010-0066143 |
| Jul. 9, 2010 | (KR) | 10-2010-0066145 |
| Jul. 9, 2010 | (KR) | 10-2010-0066147 |

(51) Int. Cl.
*F21S 4/00* (2006.01)

(52) U.S. Cl. ..... 362/249.02; 362/294; 362/249.01; 362/382; 362/431

(58) Field of Classification Search ..... 362/249.01, 362/249.02, 382, 431, 373
See application file for complete search history.

(56) References Cited

U.S. PATENT DOCUMENTS

| | | | | |
|---|---|---|---|---|
| 4,742,630 | A * | 5/1988 | Scumaci | 40/333 |
| 2009/0034255 | A1* | 2/2009 | Li | 362/249 |
| 2009/0168416 | A1 | 7/2009 | Zhang et al. | |
| 2009/0237930 | A1* | 9/2009 | Li | 362/235 |
| 2011/0038153 | A1* | 2/2011 | Hu | 362/249.02 |
| 2011/0044043 | A1* | 2/2011 | Wong | 362/249.02 |
| 2011/0058368 | A1* | 3/2011 | Shiau et al. | 362/225 |

FOREIGN PATENT DOCUMENTS

| | | |
|---|---|---|
| DE | 20-2009-000344 | 3/2009 |
| DE | 20 2009003239 | 8/2009 |
| EP | 2 014-970 A1 | 1/2009 |
| WO | WO 2008/125772 | 10/2008 |
| WO | WO 2010/050993 | 5/2010 |

OTHER PUBLICATIONS

European Search Report dated Oct. 31, 2011 for Application No. 10187961.7.

* cited by examiner

*Primary Examiner* — Evan Dzierzynski
(74) *Attorney, Agent, or Firm* — KED & Associates, LLP

(57) ABSTRACT

Disclosed is a street lamp. The street lamp includes:
an LED module in which a plurality of LEDs are disposed on one side of a substrate; and
a heat radiating body including a convex top surface and a bottom surface disposed on the substrate.

18 Claims, 14 Drawing Sheets

STREET LAMP

The present application claims priority under 35 U.S.C. §119(e) of Korean Patent Application Nos. 10-2010-0065215, filed in Korea on Jul. 7, 2010, 10-2010-0065216, filed in Korea on Jul. 7, 2010, 10-2010-0065218 filed in Korea on Jul. 7, 2010, 10-2010-0066139 filed in Korea on Jul. 9, 2010, 10-2010-0066141 filed in Korea on Jul. 9, 2010, 10-2010-0066143 filed in Korea on Jul. 9, 2010, 10-2010-0066145 filed in Korea on Jul. 9, 2010, 10-2010-0066147 filed in Korea on Filing Date Jul. 9, 2010, which are hereby incorporated by reference in its entirety.

BACKGROUND

1. Field

This embodiment relates to a street lamp.

2. Description of the Related Art

A street lamp is installed at a high position in a road, a pavement or a footpath, etc., which usually get dark at night. The street lamp provides visibility for pedestrians or vehicle drivers and prevents accidents or crimes.

A lamp post is erected and a lamp is attached to the lamp post. Therefore, a street lamp post means a lamp post in which the street lamp is installed.

SUMMARY

One embodiment is a street lamp. The street lamp includes:

an LED module in which a plurality of LEDs are disposed on one side of a substrate; and a heat radiating body including a convex-up top surface and a bottom surface disposed on the substrate.

Another embodiment is a street lamp. The street lamp includes:

a lamp post including a power supply disposed therein;

a lamp post connector fastened to the lamp post and supported by the lamp post;

an LED module being disposed on one side of a substrate and emitting light by receiving electric power from the power supply of the lamp post; and a heat radiating body including a top surface and a bottom surface, wherein the top surface is formed inclined to allow fluid to flow along the edge of the heat radiating body and wherein the bottom surface contacts with the other side of the substrate.

Further another aspect of this invention is a street lamp. The street lamp includes:

an LED module in which a plurality of LEDs are disposed on one side of a substrate; and a heat radiating body including a convex-up top surface and a bottom surface, wherein a plurality of heat radiating fins are arranged on the convex-up top surface in the same direction, and wherein the bottom surface is adjacent to the substrate.

DETAILED DESCRIPTION OF THE EMBODIMENTS

Hereinafter, an embodiment will be described in detail with reference to the accompanying drawings.

Figure 1:
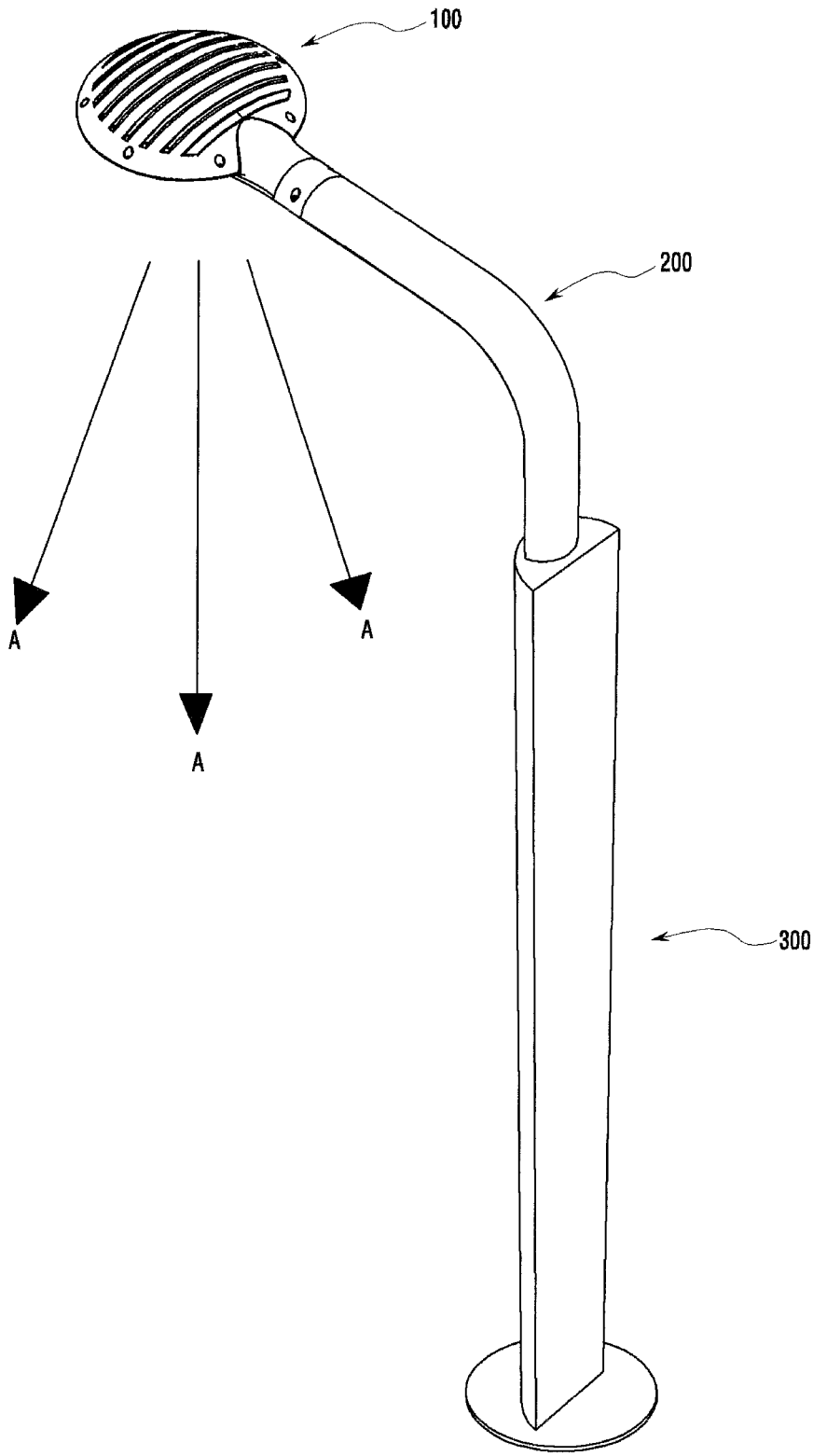
FIG. 1 is a perspective view of a street lamp according to an embodiment of the present invention.
Figure 2:
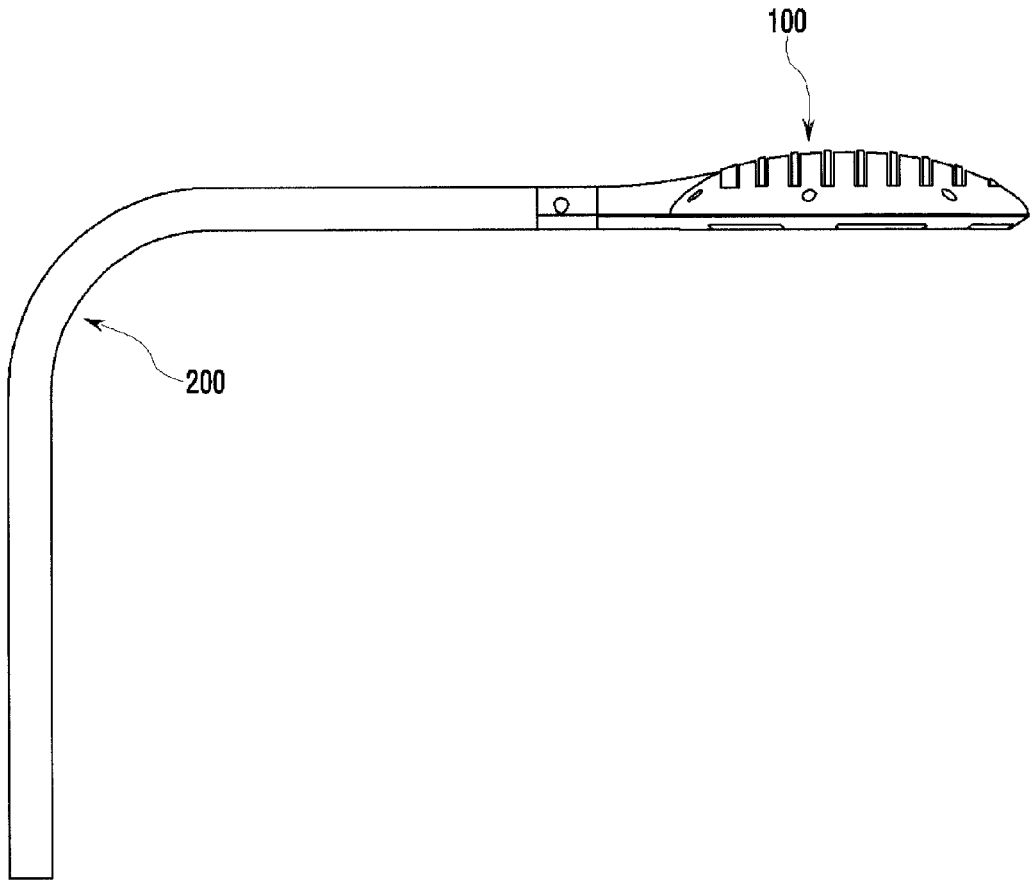
FIG. 2 is a side view showing a lamp lighting unit and a lamp post connector of the street lamp shown in FIG. 1.
Figure 3:
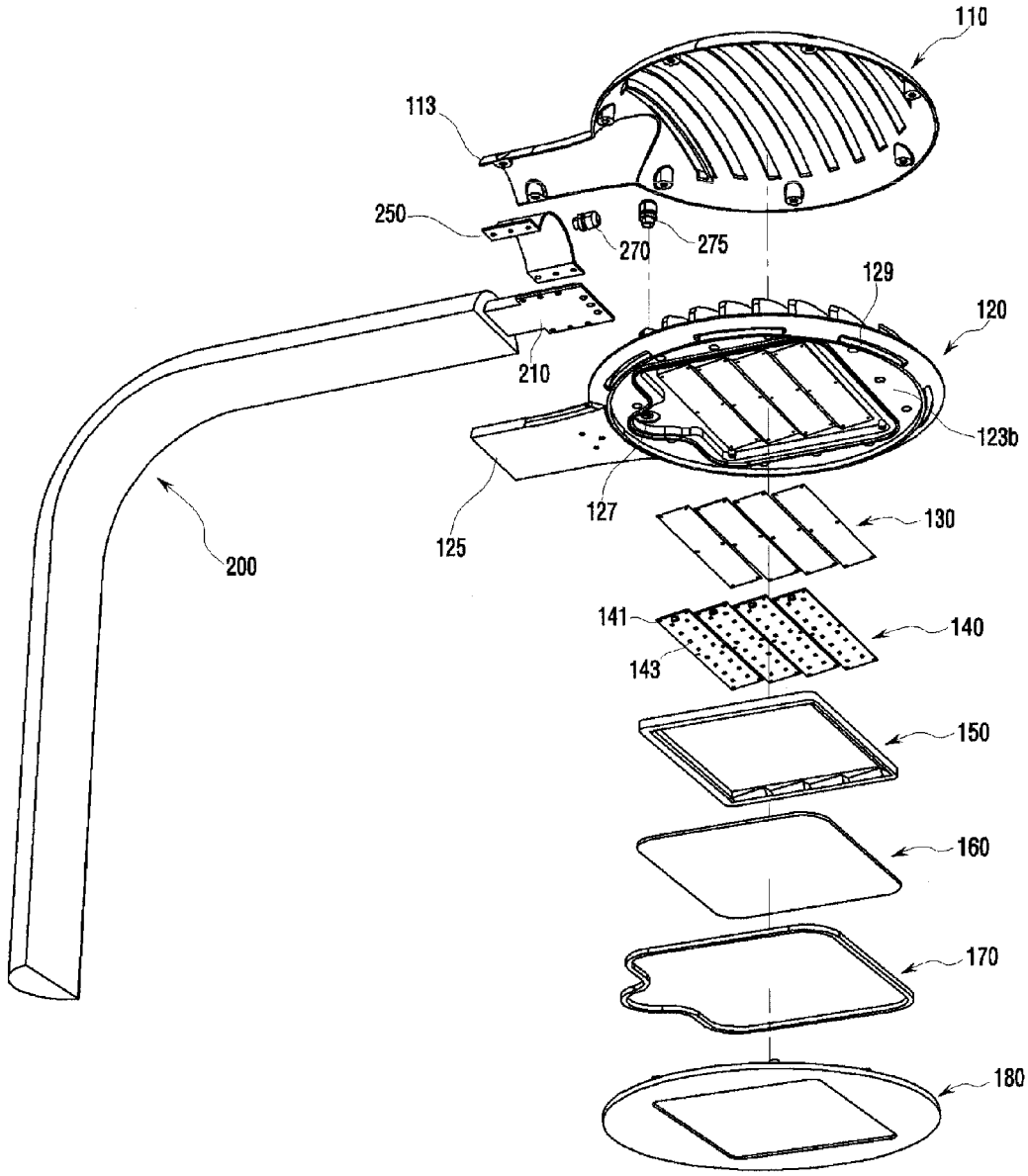
FIGS. 3 and 4 are exploded perspective views showing the lamp lighting unit and the lamp post connector of the street lamp shown in FIG. 1.
Figure 4:
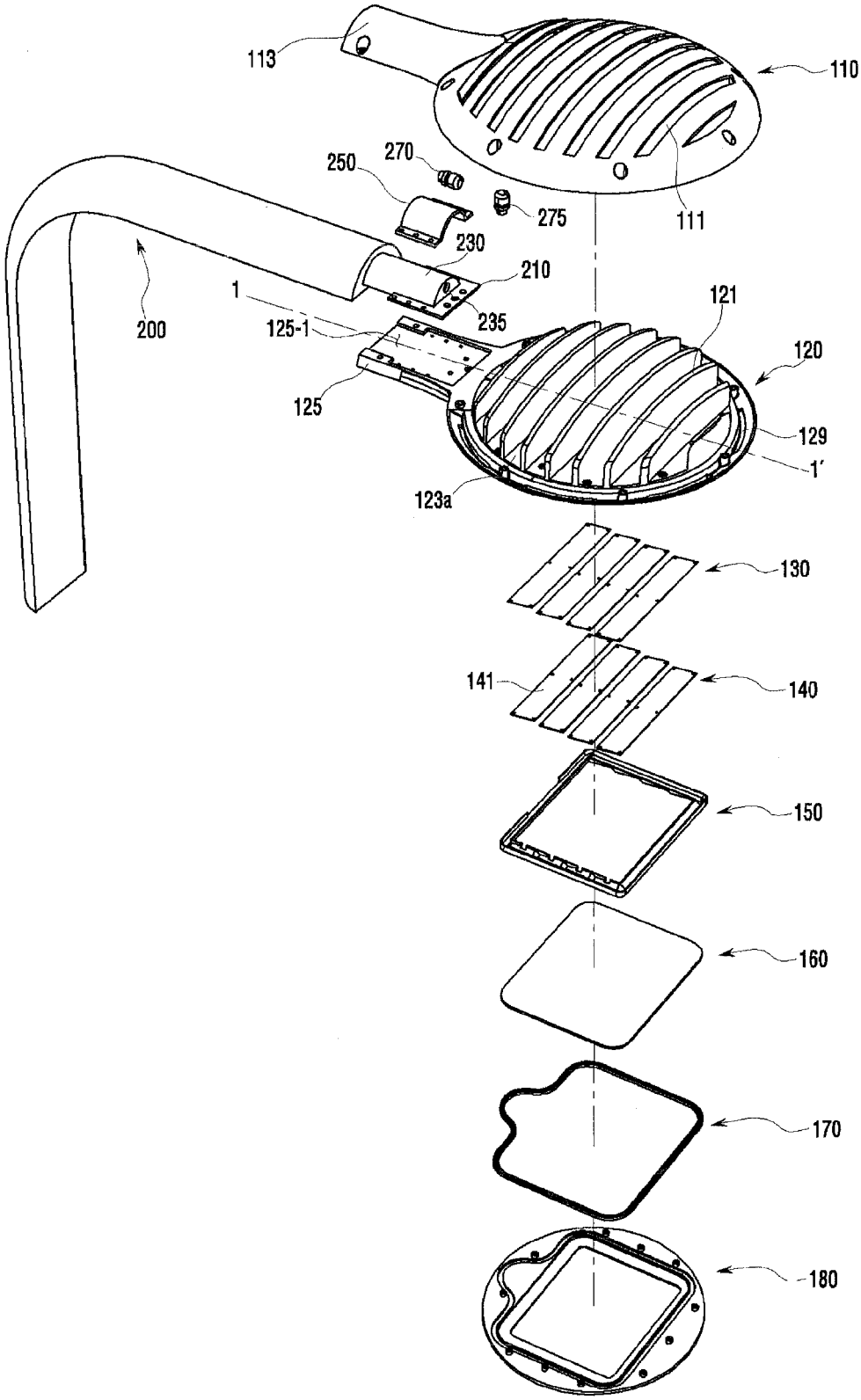

FIG. 1 is a perspective view of a street lamp according to an embodiment of the present invention. FIG. 2 is a side view showing only a lamp lighting unit 100 and a lamp post connector 200 of the street lamp shown in FIG. 1. FIGS. 3 and 4 show only the lamp lighting unit 100 and the lamp post connector 200 of the street lamp shown in FIG. 1, and particularly is an exploded perspective view of the lamp lighting unit 100. FIG. 3 is a view as viewed from the top of the street lamp. FIG. 4 is a view as viewed from the bottom of the street lamp.

Referring to FIGS. 1 to 4, a street lamp according to an embodiment of the present invention includes a lamp lighting unit 100, a lamp post connector 200 and a lamp post 300.

The lamp lighting unit 100 includes at least one light emitting diode (hereinafter, referred to as LED) as a light source. When the LED is included as a light source, the LED is provided with electric power from a power supply (not shown) included in the lamp post 300, and then emits light in directions of "A1" to "A3". The lamp lighting unit 100 will be described in detail with reference to FIGS. 3 and 4.

Referring to FIGS. 3 and 4, the lamp lighting unit 100 includes a heat radiating body cover 110, a heat radiating body 120, a thermal pad 130, an LED module 140, a connector guide 150, a cover glass 160, a packing 170 and a cover glass bracket 180.

The heat radiating body cover 110 covers a contacting part 125 and a top surface 123*a* of the heat radiating body 120. Such a heat radiating body cover 110 includes a heat radiating opening 111 formed at a position corresponding to the position of the heat radiating fin 121.

The heat radiating body cover 110 includes an extension part 113. The extension part 113 is fastened to the contacting part 125 of the heat radiating body 120. A connecting portion 210 and 230 of the lamp post connector 200 is inserted between the extension part 113 and the contacting part 125. Thus, the lamp lighting unit 100 can be fixed and disposed in the lamp post connector 200 by means of the extension part 113 and the contacting part 125.

A plurality of the LED modules 140 are disposed in the heat radiating body 120. The heat radiating body 120 receives heat from the plurality of the LED modules 140 and radiates the heat. Such a heat radiating body 120 includes the top surface 123*a* including a plurality of the heat radiating fins 121 extending outward, a bottom surface 123*b* on which the plurality of the LED modules 140 are mounted, and the contacting part 125 extending outward. The heat radiating body 120 will be described more specifically with reference to FIG. 5.

Figure 5:
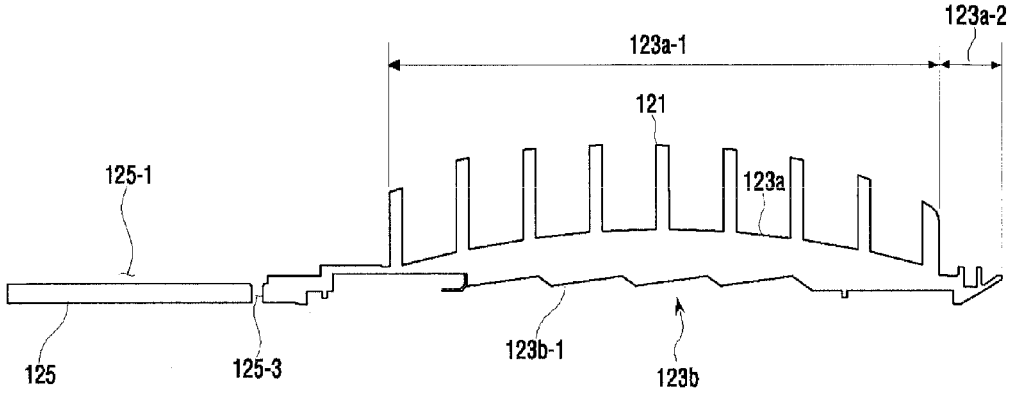
FIG. 5 is a cross sectional view taken along line 1-1' of a heat radiating body of the street lamp shown in FIGS. 3 and 4.

FIG. 5 is a cross sectional view taken along line 1-1' of the heat radiating body 120 of the street lamp shown in FIGS. 3 and 4.

Referring to FIG. 5, the heat radiating body 120 includes the top surface 123*a*, the bottom surface 123*b* and the contacting part 125.

The top surface 123*a* of the heat radiating body 120 has a convex-up shape for allowing fluid like rain water to flow along the edge of the heat radiating body 120. The top surface 123*a* of the heat radiating body 120 includes a body 123*a*-1 and an edge portion 123*a*-2. The body 123*a*-1 includes the plurality of the heat radiating fins 121 formed thereon. The edge portion 123*a*-2 surrounds the outermost of the body 123*a*-1.

The plurality of the heat radiating fins 121 are formed on the body 123*a*-1 of the top surface 123*a*. Each of the heat radiating fins 121 extends upward and outward from the surface of the body 123*a*-1, and has a shape of a flat plate. All the heat radiating fins 121 are arranged on the surface of the body 123*a*-1 of the top surface 123*a* in parallel with each other and in the same direction.

The edge portion 123*a*-2 of the top surface 123*a* includes at least one draining hole 129. The draining hole 129 functions to drain rain water flowing along the convex-up top surface 123*a* and staying at the outermost of the body 123*a*-1.

As shown in FIGS. 3 and 4, the top surface 123*a* of the heat radiating body 120 is covered with the heat radiating body cover 110. The bottom surface 123*b* of the heat radiating body 120 is covered with the cover glass bracket 180.

At least one LED module 140 is mounted on the bottom surface 123*b* of the heat radiating body 120. Therefore, the bottom surface 123*b* of the heat radiating body 120 receives heat generated from the plurality of the LED modules 140. Here, a surface contacting part 123*b*-1 on which the plurality of the LED modules 140 are mounted is formed on the bottom surface 123*b* of the heat radiating body 120. The surface contacting part 123*b*-1 may be, as shown in FIG. 5, formed obliquely or horizontally. A case where the surface contacting part 123*b*-1 of the heat radiating body 120 is inclined will be described more specifically with reference to FIG. 6.

Figure 6:
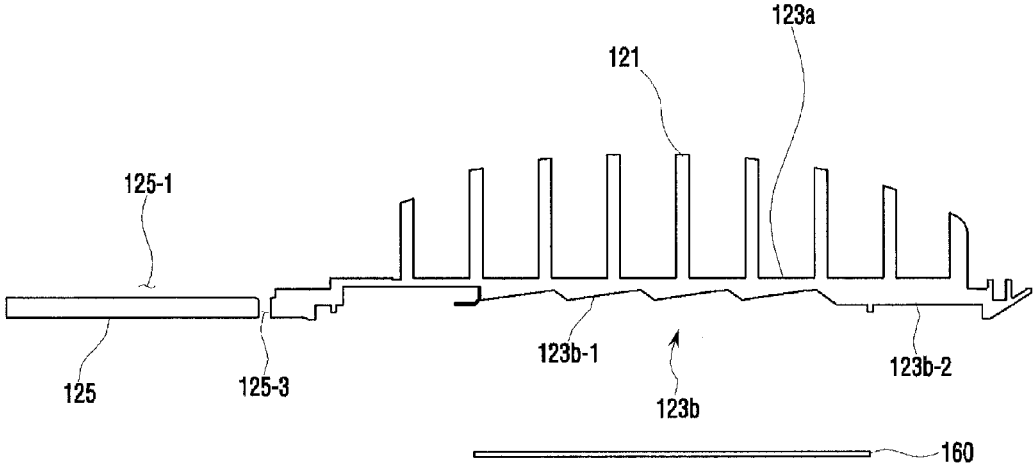
FIG. 6 is a cross sectional view showing only a cover glass and the heat radiating body shown in FIGS. 3 and 4.

FIG. 6 is a cross sectional view showing only the cover glass 160 and the heat radiating body 120 shown in FIGS. 3 and 4.

Referring to FIG. 6, at least one LED module 140 is mounted on the bottom surface 123*b* of the heat radiating body 120. The bottom surface 123*b* includes the surface contacting part 123*b*-1 which is inclined at an acute angle with respect to the cover glass 160. That is, a contact surface of the surface contacting part 123*b*-1 forms an acute angle with the surface of the cover glass 160.

When the LED module 140 is mounted on the contact surface of the surface contacting part 123*b*-1 of the heat radiating body 120, the bottom surface 123*b* of the heat radiating body 120 receives heat generated by operating the LED module 140. Here, a plurality of the surface contacting parts 123*b*-1 may be formed on the bottom surface 123*b* of the heat radiating body 120. In this case, the contact surfaces of the plurality of the surface contacting parts 123*b*-1 may have the same inclination or different inclination from each other.

Meanwhile, the cover glass 160 has a shape of a flat plate and is disposed apart from the bottom surface 123*b* of the heat radiating body 120 by a predetermined distance. Here, the cover glass 160 is parallel with a surface 123-2 with the exception of the surface contacting part 123*b*-1 of the bottom surface 123*b* of the heat radiating body 120, and forms an acute angle with the contact surface of the surface contacting part 123*b*-1 of the bottom surface 123*b*.

As shown in FIG. 3, the cover glass 160 is optically coupled to the LED module 140 such that light generated from an LED 143 of the LED module 140 is irradiated to the outside. In other words, the light of the LED 143 is incident on the cover glass 160 and is diffused or collected. Here, the cover glass 160 can perform a function of transmitting the light.

When the LED module 140 is mounted on the surface contacting part 123*b*-1 inclined at an acute angle with respect to the cover glass 160, light emitted from the LED 143 of the LED module 140 is obliquely incident on the cover glass 160, instead of being incident perpendicular to the cover glass 160. Then, the light obliquely incident on the cover glass 160 is diffused or collected according to the optical characteristic of the cover glass 160, and then is emitted. Here, regarding the light emitted from the cover glass 160, the amount of the light irradiated in a direction "A1" of FIG. 1 may be greater than that of the light irradiated in directions "A2" and "A3". A more detailed description thereof will be given below with reference to FIG. 7.

Figure 7:
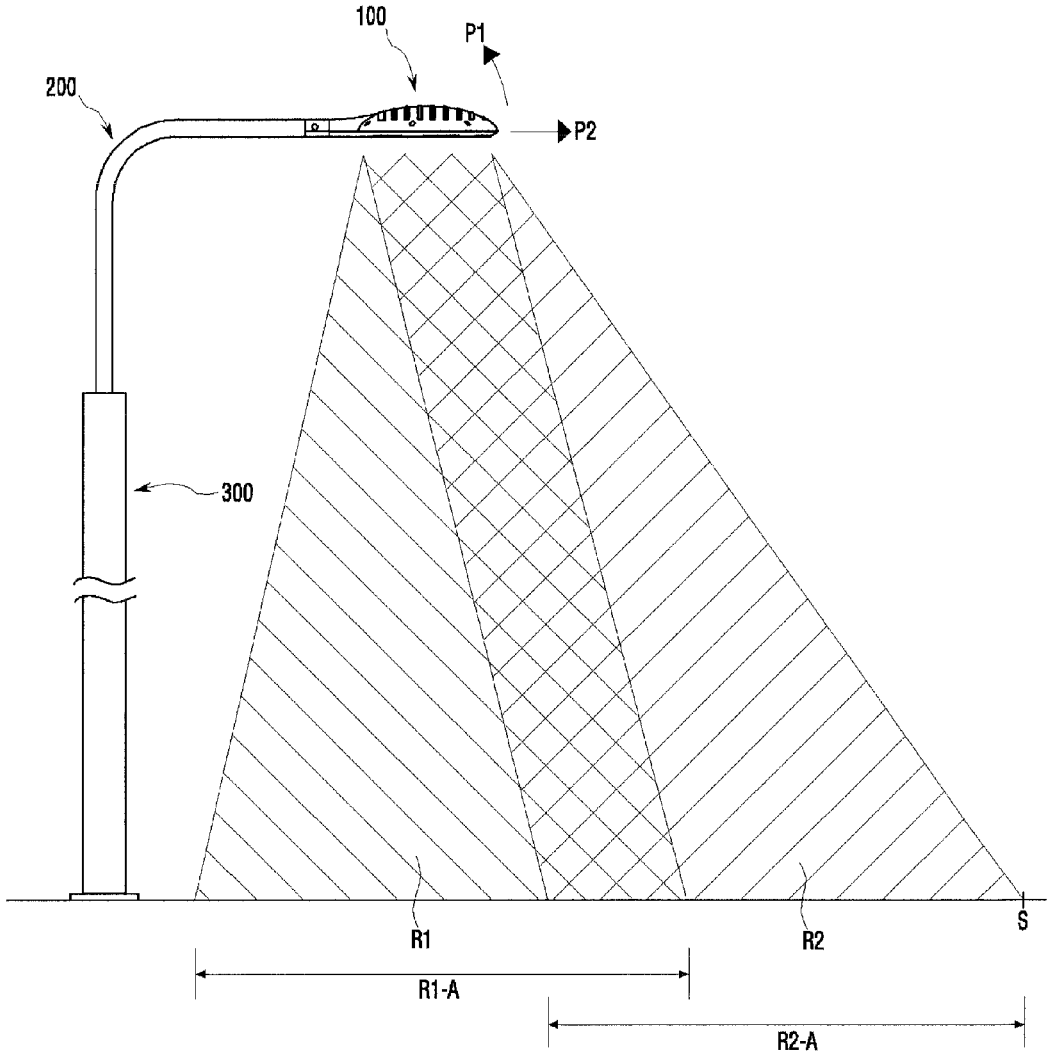
FIG. 7 is a view for describing the effect caused by structural features of a surface contacting part of the heat radiating body.

FIG. 7 is a view for describing the effect caused by structural features of a surface contacting part 123*b*-1 of the heat radiating body 120.

Referring to FIG. 7, "R1" schematically shows that light is irradiated when the contact surface of the surface contacting part 123*b*-1 is not inclined at an acute angle with respect to the cover glass 160. "R2" schematically shows that light is irradiated when the contact surface of the surface contacting part 123*b*-1 is inclined at an acute angle with respect to the cover glass 160.

When the contact surface of the surface contacting part 123*b*-1 of the heat radiating body 120 is not inclined at an acute angle with respect to the cover glass 160, the light is not irradiated to a point "S". When the contact surface of the surface contacting part 123*b*-1 of the heat radiating body 120 is inclined at an acute angle with respect to the cover glass 160, the light is irradiated to a point "S". If the light is required to be irradiated to the point "S" under the condition that the contact surface of the surface contacting part 123*b*-1 of the heat radiating body 120 is not inclined at an acute angle with respect to the cover glass 160, the lamp post connector 200 is required to be extended in a direction "P2" or to be bent in a direction "P1".

However, when the contact surface of the surface contacting part 123*b*-1 of the heat radiating body 120 according to the embodiment of the present invention is inclined at an acute angle with respect to the cover glass 160, the light can be irradiated to the point "S" without extending the lamp post connector 200 in the direction "P2" or bending the lamp post connector 200 in the direction "P1".

An irradiation area R2-A which is formed when the surface contacting part 123*b*-1 of the heat radiating body 120 according to the embodiment of the present invention is inclined at an acute angle with respect to the cover glass 160 is larger than an irradiation area R1-A which is formed when the surface contacting part 123*b*-1 of the heat radiating body 120 is not inclined at an acute angle with respect to the cover glass 160. Accordingly, an irradiation area of the street lamp according to the embodiment of the present invention becomes larger.

The contacting part 125 of the heat radiating body 120 will be described again with reference to FIG. 5. Here, FIG. 8 is also considered for the sake of convenience of the description.

Figure 8:
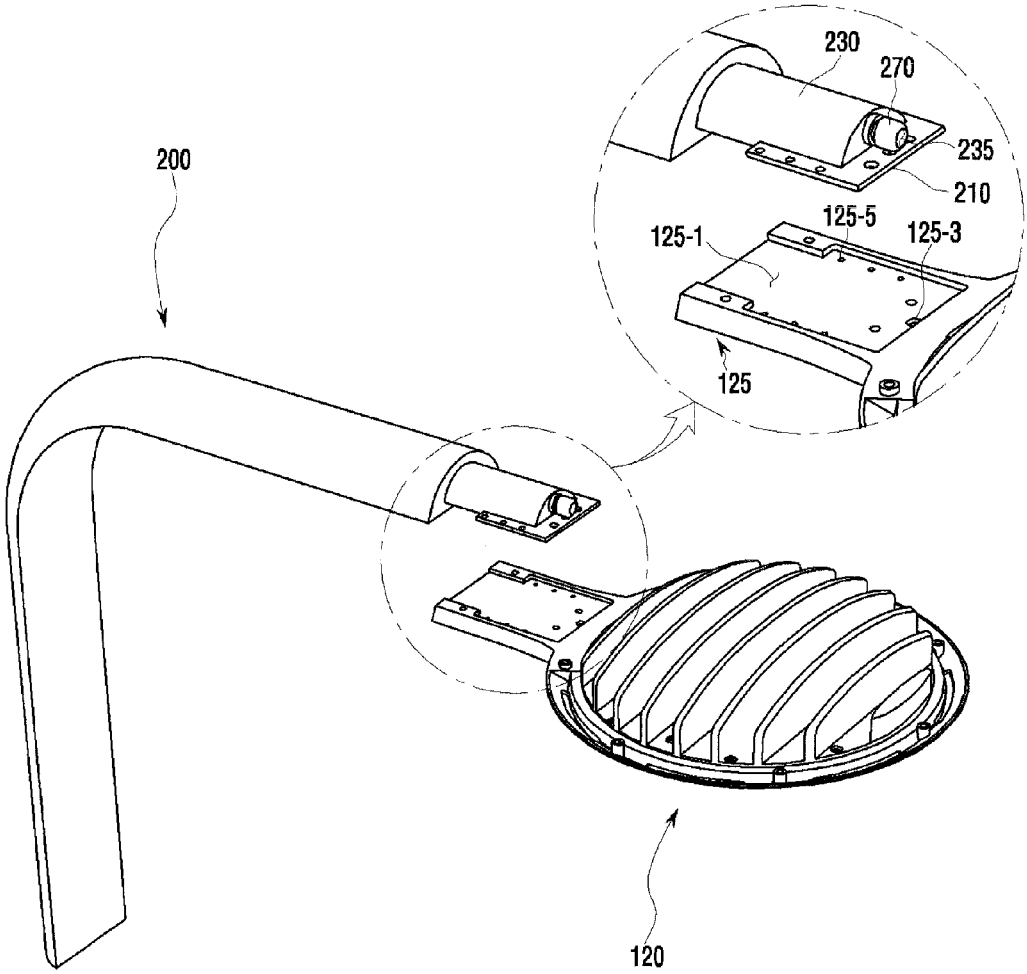
FIG. 8 is an enlarged perspective view showing that the lamp post connector is fastened to the heat radiating body of the lamp lighting unit.

FIG. 8 is an enlarged perspective view showing that the lamp post connector 200 is connected to the heat radiating body 120 of the lamp lighting unit 100.

Referring to FIGS. 5 and 8, the contacting part 125 of the heat radiating body 120 comes in surface contact with a flat portion 210 of the lamp post connector 200 and a flat surface of a semi-cylindrical portion 230 of the lamp post connector 200. To this end, the contacting part 125 of the heat radiating body 120 includes a seating groove 125-1 for receiving the flat portion 210 and the flat surface of the semi-cylindrical portion 230. The flat portion 210 and the flat surface of the semi-cylindrical portion 230 are inserted and fixed into the seating groove 125-1, so that flat portion 210 and the flat surface of the semi-cylindrical portion 230 can come in surface contact with the contacting part 125 of the heat radiating body 120.

It is preferable that the contacting part 125 of the heat radiating body 120 includes a draining hole 125-3. The draining hole 125-3 functions to discharge fluid generated by a temperature difference between an external temperature and an internal temperature of the street lamp, when the flat portion 210 of the lamp post connector 200 and the flat surface of the semi-cylindrical portion 230 of the lamp post connector 200 come in surface contact with the contacting part 125 of the heat radiating body 120. If the fluid is not discharged, the heat radiating body 120 and the lamp post connector 200 are easily corroded. Therefore, the contacting part 125 of the heat radiating body 120 is required to have the draining hole 125-3.

The contacting part 125 of the heat radiating body 120 is fastened to the flat portion 210 of the lamp post connector 200 by means of a fixing means (e.g., a screw, etc.), so that the heat radiating body 120 can be securely fixed to the lamp post connector 200.

As such, the contacting part 125 of the heat radiating body 120 comes in surface contact with the flat portion 210 of the lamp post connector 200 and the flat surface of the semi-cylindrical portion 230 of the lamp post connector 200, so that the heat radiating body 120 can transfer a part of heat from the LED module 140 to the lamp post connector 200, whereby there is an advantage that the heat radiating body 120 can dissipate the heat, which should be radiated by the heat radiating body 120 itself, to the lamp post connector 200. Further, the contacting part 125 of the heat radiating body 120 comes in surface contact with the flat portion 210 of the lamp post connector 200 and the flat surface of the semi-cylindrical portion 230 of the lamp post connector 200, whereby there is an advantage that the heat radiating body 120 can be fixed and supported to the lamp post connector 200.

Meanwhile, the structural features of the heat radiating body 120 and the heat radiating body cover 110 will be described specifically with reference to FIGS. 9 to 11.

Figure 9:
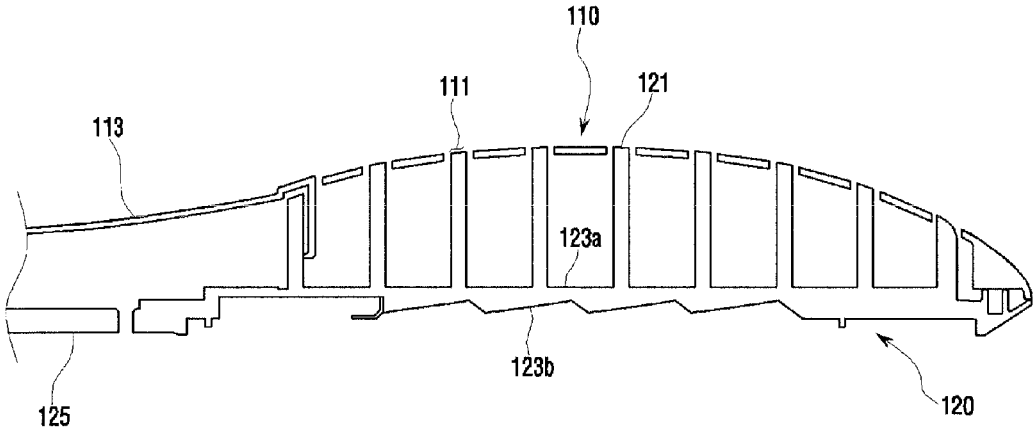
FIG. 9 is a view showing that a heat radiating body cover is disposed at positions of peaks of a plurality of heat radiating fins.

FIG. 9 is a view showing that a heat radiating body cover 110 is disposed at positions of peaks of a plurality of heat radiating fins 121. FIG. 10 is a view showing that a heat radiating body cover 110 is disposed at positions lower than positions of peaks of a plurality of heat radiating fins 121. FIG. 11 is a view showing that a heat radiating body cover 110 is disposed at positions higher than positions of peaks of a plurality of heat radiating fins 121.

Figure 10:
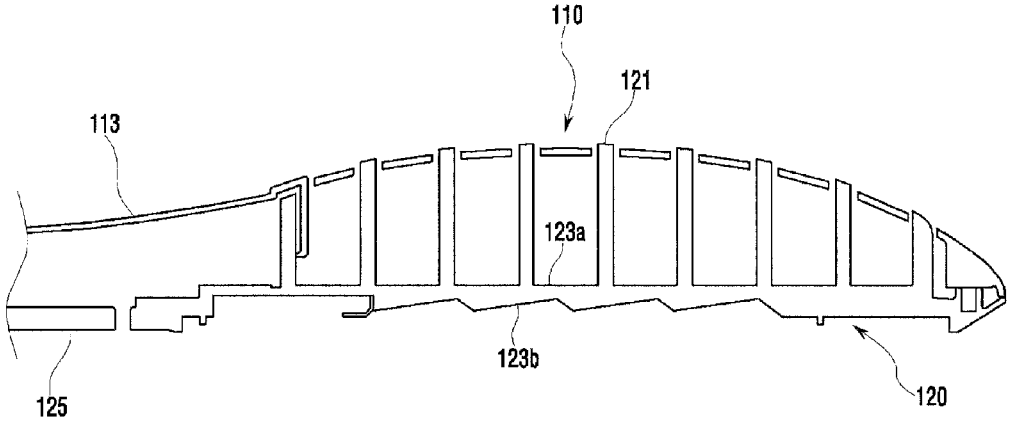
FIG. 10 is a view showing that a heat radiating body cover is disposed at positions lower than positions of peaks of a plurality of heat radiating fins.
Figure 11:
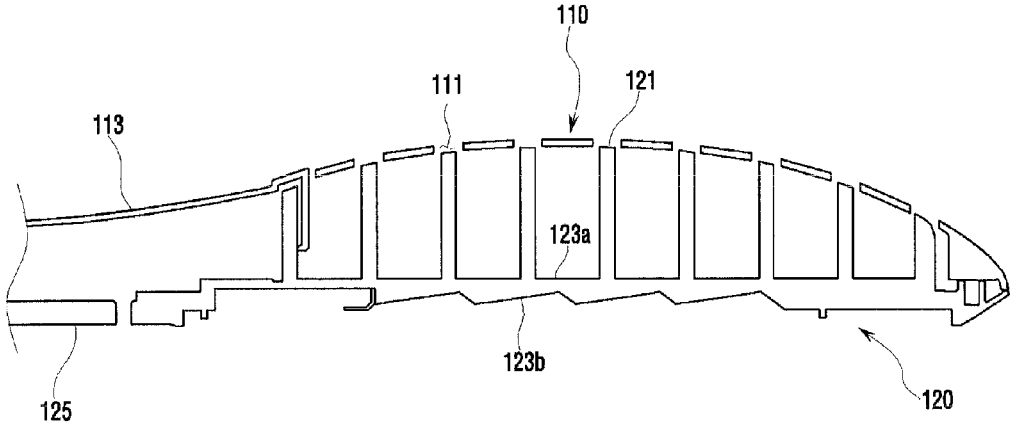
FIG. 11 is a view showing that a heat radiating body cover is disposed at positions higher than positions of peaks of a plurality of heat radiating fins.

Referring to FIGS. 9 to 11, the heat radiating body 120 includes the top surface 123*a*, the bottom surface 123*b* and contacting part 125. The heat radiating body cover 110 includes the heat radiating opening 111 and the extension part 113.

The plurality of the heat radiating fins 121 are formed on the top surface 123*a* of the heat radiating body 120. The heat radiating body cover 110 is disposed on the top surface 123*a* of the heat radiating body 120 in such a manner as to cover the top surface 123*a* of the heat radiating body 120.

The heat radiating body cover 110 is disposed at positions of peaks of a plurality of the heat radiating fins 121. The heat radiating body cover 110 includes at least one heat radiating opening 111 or the heat radiating openings 111 of which the number is the same as the number of the heat radiating fins 121. Here, when the heat radiating body cover 110 includes the heat radiating openings 111 of which the number is the same as the number of the heat radiating fins 121, it is required that the heat radiating opening 111 should be formed at a position corresponding to the position of the heat radiating fin 121.

Meanwhile, the heat radiating fin 121 is not exactly fitted to the heat radiating opening 111. That is, the heat radiating fin 121 is required to have a size and shape for allowing the heat radiating fin 121 to freely passing through the heat radiating opening 111. Therefore, it is desirable that the plurality of the heat radiating openings 111 have the same shapes as those of the plurality of the heat radiating fins 121 and are arranged in parallel with each other in one direction in the same way as the heat radiating fins 121 are arranged.

The structures shown in FIGS. 9 to 11 formed by the heat radiating body cover 110 and the heat radiating body 120 causes the heat radiated from the heat radiating body 120 to be easily exhausted to the outside through the heat radiating opening 111 of the heat radiating body cover 110.

Additionally, it is possible to mitigate the temperature rise of the heat radiating body 120 caused by sunlight. For example, but for the heat radiating body cover 110, the temperature of the heat radiating body 120 is raised by sunlight as well as the LED module 140. As a result, the LED module 140 may be rather damaged by the heat from the heat radiating body 120.

Since the heat radiating body cover 110 includes the heat radiating opening 111, fluid like rain water may be directly flown into the top surface 123*a* of the heat radiating body 120 through the heat radiating opening 111. When fluid is flown into the heat radiating body 120, it is possible to easily radiate the heat transferred from the LED module 140.

Hereinafter, an arrangement relationship between the heat radiating body cover 110 and the heat radiating body 120 will be described.

The arrangement relationship of FIGS. 10 and 11 may be more effective than that of FIG. 9 from the viewpoint of the heat radiation and the flowing-in of the fluid.

FIG. 10 shows an arrangement relationship that heat radiating body cover 110 is disposed at position lower than position of peak of the heat radiating fin 121. In this case, the wind or fluid flowing along the top surface of the heat radiating body cover 110 collides with the peak of the heat radiating fin 121 and easily flows between the heat radiating body cover 110 and the top surface 123*a* of the heat radiating body 120.

FIG. 11 shows an arrangement relationship that heat radiating body cover 110 is disposed at position higher than position of peak of the heat radiating fin 121. In this case, an opening area of the heat radiating opening 111 is greater than those of FIGS. 9 and 10. Therefore, a fluid can flow more easily between the heat radiating body cover 110 and the top surface 123*a* of the heat radiating body 120.

Referring to FIGS. 3 and 4 again, the thermal pad 130 is disposed between the surface contacting part 123*b*-1 of the heat radiating body 120 and the LED module 140. The thermal pad 130 can efficiently transfer the heat generated from the LED module 140 to the heat radiating body 120.

The LED module 140 includes a flat PCB substrate 141 and a plurality of the LEDs 143 arranged on one side of the PCB substrate 141. The other side of flat PCB substrate 141 contacts with the bottom surface 123*b* of the heat radiating body 120. Unlike general LED modules, such an LED module 140 may have special structural features. The special structural features of the LED module 140 will be described specifically with reference to FIG. 12.

Figure 12:
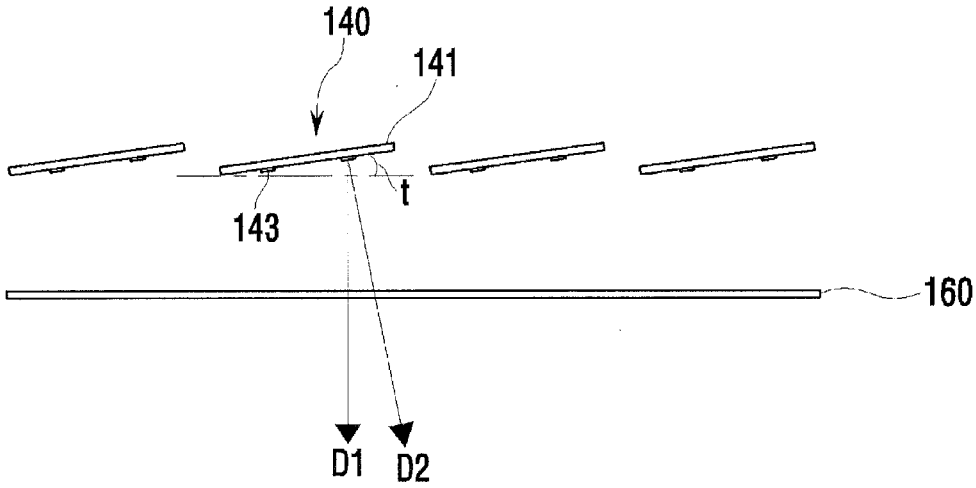
FIG. 12 is a cross-sectional side view showing only LED modules and the cover glass.

FIG. 12 is a cross-sectional side view showing only LED module 140 and the cover glass 160.

Referring to FIG. 12, it is required that the flat PCB substrate 141 of the LED module 140 should not be in parallel with the flat cover glass 160 and form a predetermined angle "t" with the flat cover glass 160. Here, it is preferable that the predetermined angle "t" is an acute angle.

When the flat PCB substrate 141 of the LED module 140 forms a predetermined angle "t" with the cover glass 160, light emitted from the LED 143 of the LED module 140 is not irradiated in a direction "D1" perpendicular to the cover glass 160 and is schematically irradiated in a direction "D2". The effect caused by obliquely arranging the flat PCB substrate 141 of the LED module 140 with respect to the cover glass 160 will be described with reference to FIG. 13.

Figure 13:
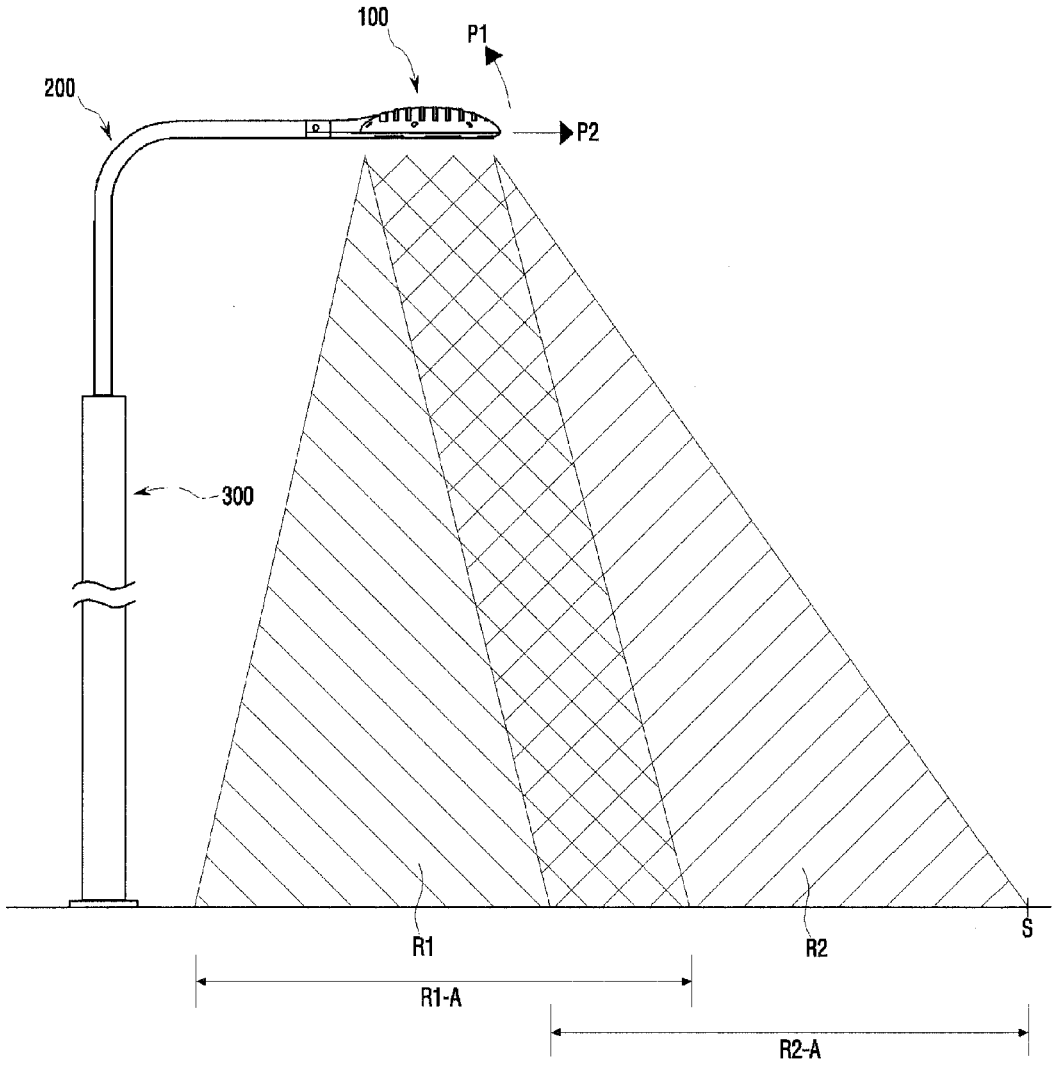
FIG. 13 is a view for describing the effect caused by structural features of a PCB substrate of the LED modules.

FIG. 13 is a view for describing the effect caused by structural features of a PCB substrate 141 of the LED modules 140.

Referring to FIG. 13, the lamp lighting unit 100 includes the LED module 140 and the cover glass 160 which are shown in FIG. 12.

Referring to FIGS. 12 and 13, "R1" schematically shows that light is irradiated when the PCB substrate 141 of the LED module 140 is not inclined at an acute angle with respect to the cover glass 160. "R2" schematically shows that light is irradiated when the PCB substrate 141 of the LED module 140 is inclined at an acute angle with respect to the cover glass 160.

When the PCB substrate 141 of the LED module 140 is not inclined at an acute angle with respect to the cover glass 160, the light emitted from the LED 143 of the LED module 140 is not irradiated to a point "S". However, when the PCB substrate 141 of the LED module 140 is inclined at an acute angle with respect to the cover glass 160, the light emitted from the LED 143 of the LED module 140 is irradiated to a point "S".

If the light emitted from the LED 143 of the LED module 140 is required to be irradiated to the point "S" under the condition that the PCB substrate 141 of the LED module 140 is not inclined at an acute angle with respect to the cover glass 160, the lamp post connector 200 is required to be extended in a direction "P2" or to be bent in a direction "P1". However, when the PCB substrate 141 of the LED module 140 is inclined at an acute angle with respect to the cover glass 160, the light can be irradiated to the point "S" or to a point farther than the point "S" only by adjusting the angle of the PCB substrate 141 of the LED module 140 without extending the lamp post connector 200 in the direction "P2" or bending the lamp post connector 200 in the direction "P1".

An irradiation area R2-A which is formed when the PCB substrate 141 of the LED module 140 according to the embodiment of the present invention is inclined at an acute angle with respect to the cover glass 160 is larger than an irradiation area R1-A which is formed when the PCB substrate 141 of the LED module 140 is not inclined at an acute angle with respect to the cover glass 160. Accordingly, an irradiation area of the street lamp according to the embodiment of the present invention becomes larger.

Referring to FIGS. 3 and 4 again, the connector guide 150 is disposed on the bottom surface 123*b* of the heat radiating body 120 in which the LED module 140 is mounted. The connector guide 150 prevents the LED module 140 from separating from the bottom surface 123*b* of the heat radiating body 120. Such a connector guide 150 has a shape of a rectangular frame. Here, the bottom surface 123*b* of the heat radiating body 120 is required to have a groove to which the connector guide 150 is inserted and fixed.

The cover glass 160 has a shape of a flat plate and is disposed apart from the LED module 140 mounted on the bottom surface 123*b* of the heat radiating body 120 by a predetermined distance. More specifically, the cover glass 160 is mounted on the cover glass bracket 180 and may be disposed under the LED module 140 mounted on the bottom surface 123*b* of the heat radiating body 120.

The cover glass 160 is optically coupled to the LED module 140 such that light generated from an LED 143 of the LED module 140 is irradiated to the outside. In other words, the light of the LED 143 is incident on the cover glass 160 and is diffused or collected. Here, the cover glass 160 can perform a function of transmitting the light.

The packing 170 is inserted and fixed into a packing groove formed on the bottom surface 123*b* of the heat radiating body 120 and on the cover glass bracket 180. The packing 170 is made of a rubber material or a silicon material and functions to prevent fluid from entering the LED module of an electronic device. In other words, the packing 170 prevents fluid flowing along the top surface 123*a* to the bottom surface 123*b* of the heat radiating body 120 from approaching the LED module 140.

The cover glass bracket 180 is disposed to cover the bottom surface 123*b* of the heat radiating body 120 and has a frame shape having a central opening. A groove for receiving the cover glass 160 is formed at the inner portion of the cover glass bracket 180. A groove for receiving the packing 170 is formed at the outer portion of the cover glass bracket 180.

The lamp lighting unit 100 is supported by fastening one end of the lamp post connector 200 to the lamp lighting unit 100. The lamp post connector 200 is supported by fastening the other end of the lamp post connector 200 to a connecting portion (not shown) of the lamp post 300. As shown in FIG. 2, the lamp post connector 200 has a semi-cylindrical shape and is approximately bent at a right angle. The lamp post connector 200 has an empty or hollow interior. A cable (not shown) is provided inside the lamp post connector 200. The cable transmits electric power from a power supply (not shown) included within the lamp post 300 to the lamp lighting unit 100.

The connecting portion 210 and 230 of the lamp post connector 200 includes the flat portion 210 and the semi-cylindrical portion 230. Here, the connecting portion 210 and 230 is formed of a material for receiving heat from the heat radiating body 120. For example, the connecting portion 210 and 230 may be formed of a material having thermal conductivity, such as aluminum, iron, etc.

The flat portion 210 is formed extending from the outer surface of the semi-cylindrical portion 230 and has a flat shape for allowing the flat portion 210 to come in surface contact with the contacting part 125 of the heat radiating body 120.

The semi-cylindrical portion 230 has an empty interior and a semi-cylindrical shape. A cable opening 235 through which a cable (not shown) passes is formed on one side of the semi-cylindrical portion 230. Here, a first cable locker 270 for preventing the cable (not shown) from moving or being damaged may be disposed on the cable opening 235. A second cable locker 275 having the same function as that of the first cable locker 270 may be disposed with respect to a through portion 127 passing through the top surface 123*a* and the bottom surface 123*b* of the heat radiating body 120.

Meanwhile, a heat radiating body bracket 250 may be disposed between the extension part 113 of the heat radiating body cover 110 and the semi-cylindrical portion 230 of the lamp post connector 200. The heat radiating body bracket 250 surrounds the semi-cylindrical portion 230 and has a structure that both sides of the semi-cylindrical portion 230 are fastened to the flat portion 210. Through the addition of the heat radiating body bracket 250, the heat radiating body 120 is strongly fixed to the lamp post connector 200.

Hereinafter, the lamp post 300 shown in FIG. 1 will be described specifically.

Referring to FIG. 1, the lower part of the lamp post 300 is fixed to the ground and extends from the ground. The upper part of the lamp post 300 is fastened to one end of the lamp post connector 200 and supports the lamp post connector 200. The features of the lamp post 300 will be described with reference to FIGS. 14 to 17.

Figure 14:
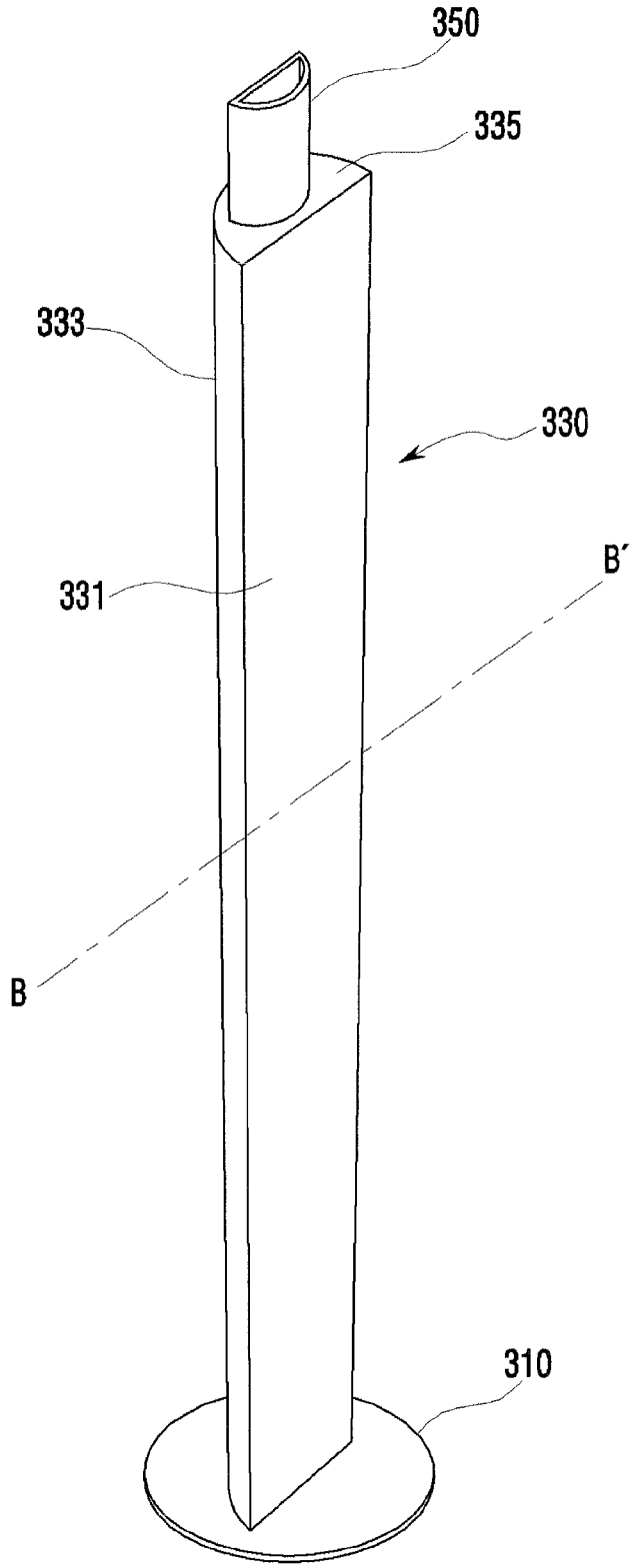
FIG. 14 is a perspective view showing only the lamp post shown in FIG. 1.
Figure 15:
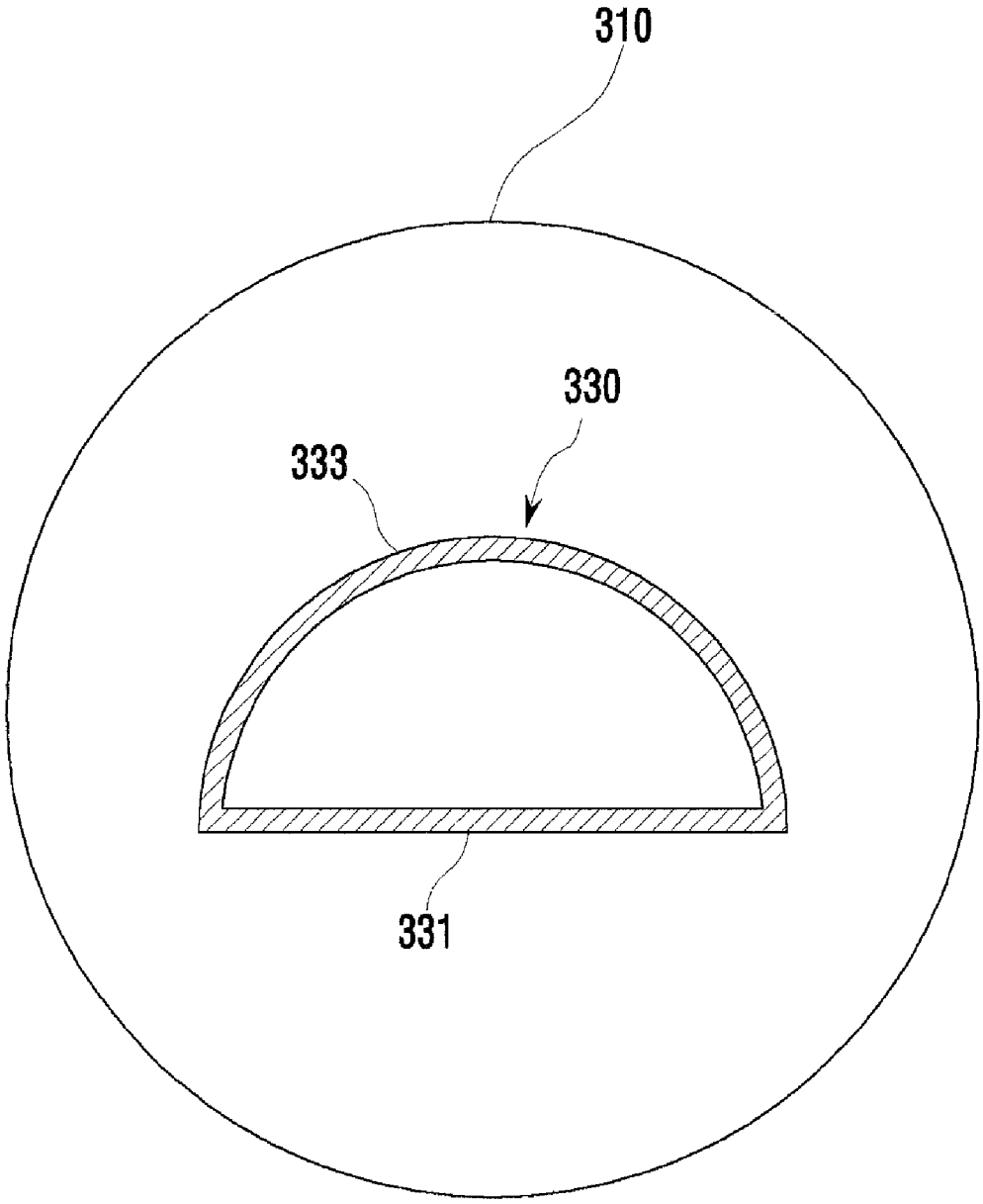
FIG. 15 is a cross sectional view taken along line B-B' of the lamp post shown in FIG. 14.

FIG. 14 is a perspective view showing only the lamp post 300 shown in FIG. 1. FIG. 15 is a cross sectional view taken along line B-B' of the lamp post 300 shown in FIG. 14.

Referring to FIGS. 14 and 15, a base 310 has a flat disk shape and is fixed to the ground. The base 310 has a structure to which the lower part of a post portion 330 can be fixed. For example, the lower part of the post portion 330 may be inserted and fixed into a groove formed at the center of the base 310. The base 310 may be configured to form a projection (not shown) shaped similarly to a connector 350 at the center of the base 310 such that the projection is inserted into the lower part of the post portion 330. Further, it is noted that the lower part of the post portion 330 can be mounted on the base 310 having various shapes.

The post portion 330 has an empty interior and a shape with a curved surface. The post portion 330 extends from the ground. The lower part of the post portion 330 is fixed and mounted on the base 310. Here, it is desirable that the outer surface of the post portion 330 should include at least one flat portion 331. Thus, the outer surface of the post portion 330 with the exception of the flat portion 331 may have a predetermined curved surface 333. According to the most desirable embodiment of the present invention, the post portion 330 is required to have a semi-cylindrical shape with an empty interior and a curved surface.

The post portion 330 is required to be made of a material having thermal conductivity so as to efficiently radiate heat generated from a power supply (not shown) disposed within the post portion 330.

The connector 350 extends from a top surface 335 of the post portion 330 by a predetermined distance. The connector 350 also has an empty interior and a shape with a curved surface. While FIG. 14 shows that the connector 350 has a semi-cylindrical shape similar to the shape of the post portion 330, the connector 350 may have various shapes without being limited to this. In particular, it is preferable that the connector 350 is formed to have a shape which can be inserted within one end of the lamp post connector 200 shown in FIG. 1. That is, if the connector 350 has a shape the same as or similar to the shape of the one end of the lamp post connector 200, the connector 50 can be easily fastened to the lamp post connector 200 and support strongly the lamp post connector 200. When the connector 350 is inserted within the end of the lamp post connector 200, the end of the lamp post connector 200 comes in contact with the top surface 335 of the post portion 330. Therefore, the lamp post connector 200 can be securely fixed to the lamp post 300 without using another fixing member, for example, a screw.

Figure 16:
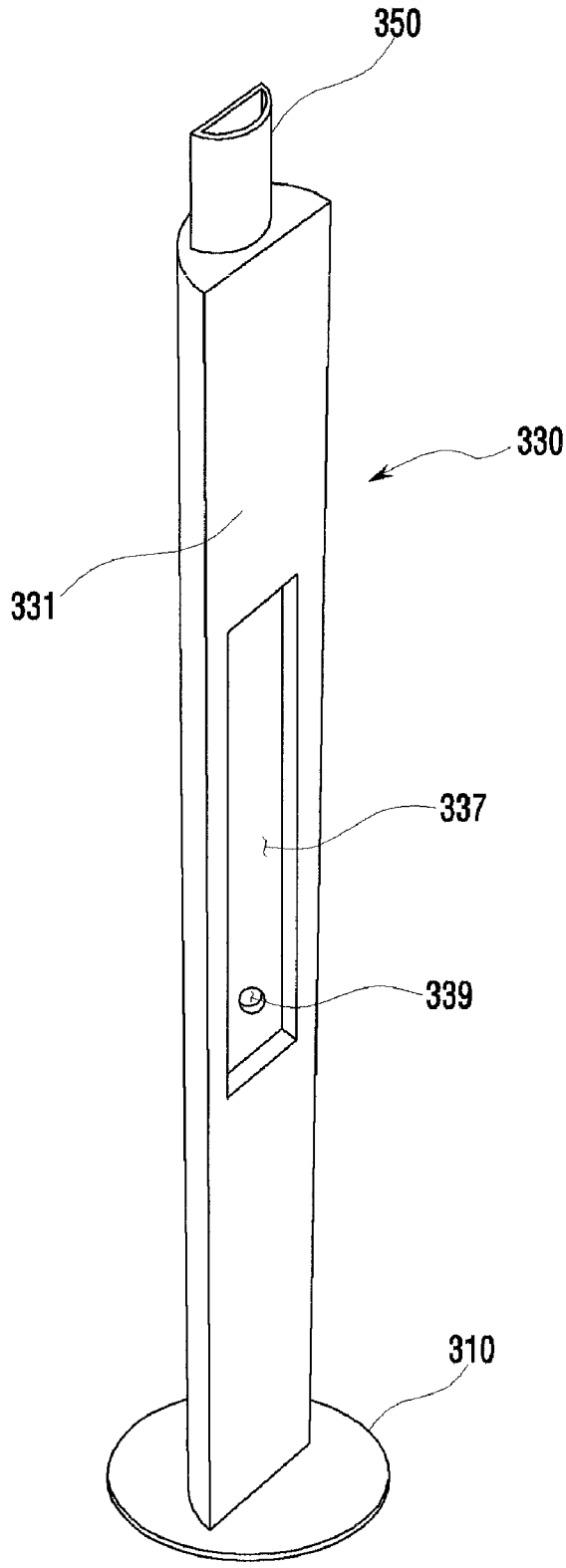
FIG. 16 is a perspective view for describing an additional embodiment of the lamp post.

FIG. 16 is a perspective view for describing an additional embodiment of the lamp post 300.

Referring to FIG. 16, the flat portion 331 of the post portion 330 may have a receiving portion 337. In other words, a height difference is formed between the flat portion 331 and the bottom surface of the receiving portion 337.

Advertisements, etc., may be attached to the bottom surface of the receiving portion 337. In this case, pedestrians or users can obtain various information.

Particularly, an LCD or LED display device may be attached to the receiving portion 337. When the LCD or LED display device is attached to the receiving portion 337, the post portion 330 made of a material having thermal conductivity can easily radiate heat generated from the LCD or LED display device. The post portion 330 can also provide users with larger amount of information than that of advertisement information.

Here, when the LCD or LED display device is attached to the receiving portion 337, a through hole 339 is required to be formed on the bottom surface of the receiving portion 337 in order to allow a power cable of the LCD or LED display device to be connected to a power supply (not shown) disposed within the post portion 330.

Figure 17:
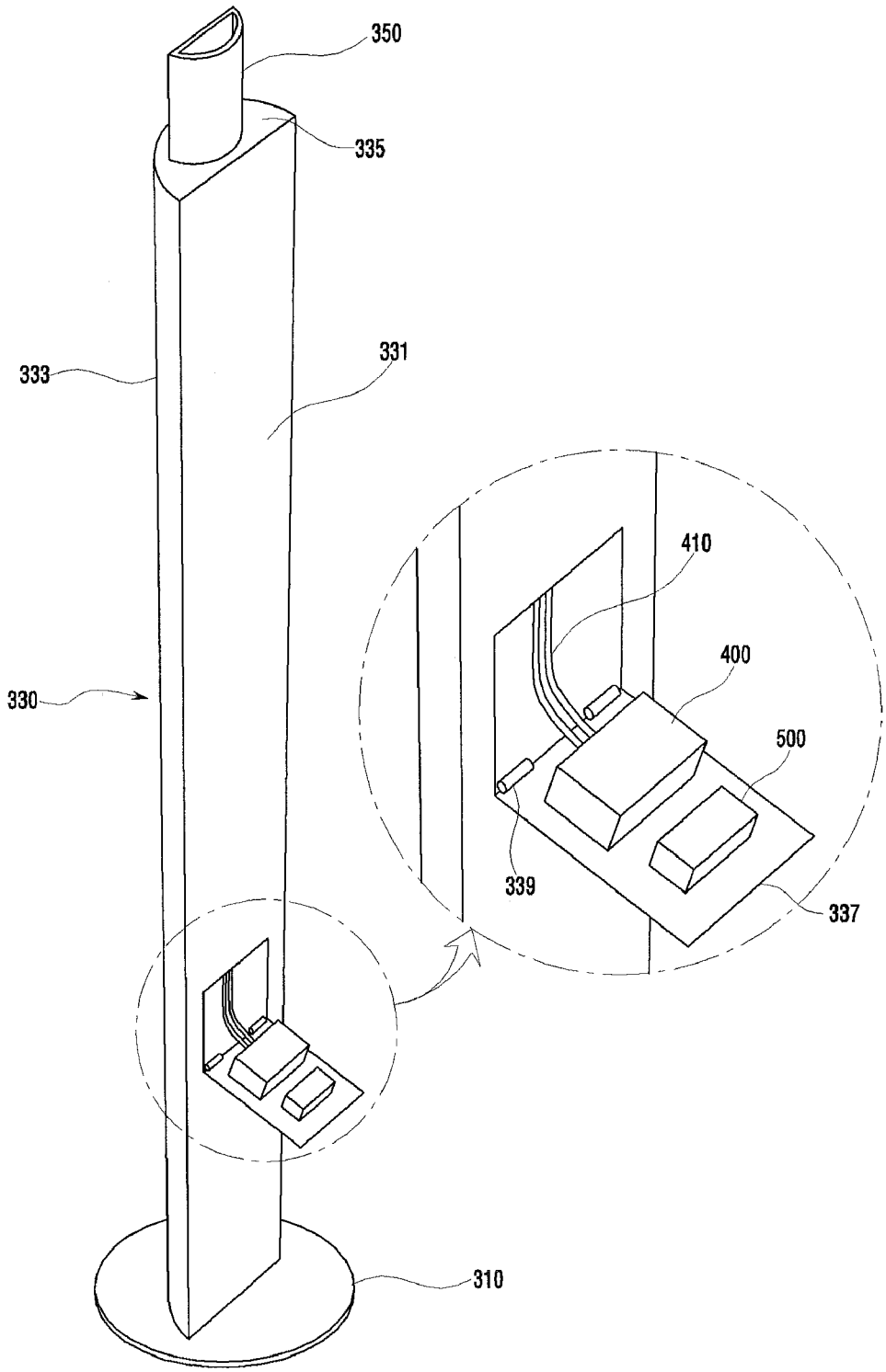
FIG. 17 is an enlarged perspective view for describing an additional embodiment of the lamp post.

FIG. 17 is an enlarged perspective view for describing an additional embodiment of the lamp post 300.

Referring to FIG. 17, the post portion 330 is required to be made of a material having thermal conductivity so as to efficiently radiate heat generated from a power supply 400 disposed to come in surface contact with the inner surface of an opening/closing portion 336 of the flat portion 331.

The flat portion 331 has a structure for allowing the inner surface of the opening/closing portion 336. For example, the inner surface of the opening/closing portion 336 may be disclosed to the outside by using a hinge 339. Here, the opening/closing portion 336 is connected to the flat portion 331 by means of the hinge 339. The structure of the opening/closing portion 336 makes it possible to easily maintain the street lamp.

Measuring equipments 500 other than the power supply 400 may be additionally mounted on the inner surface of the opening/closing portion 336. The measuring equipments 500 are also required to come in surface contact with the inner surface of the opening/closing portion 336.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

Although embodiments of the present invention were described above, theses are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A street lamp comprising:

a light emitting diode (LED) module including a plurality of LEDs disposed on one side of a substrate; and a heat radiating body having a convex-up top surface and a bottom surface disposed on the substrate, wherein the top surface of the heat radiating body has a hemispherical shape, and the top surface has at least two heat radiating fins that extend from the top surface having the hemispherical shape, the top surface having a first convex shape from a first end to a second end along a first direction, the top surface further having a second convex shape from a first side to a second side along a second direction that is transverse to the first direction, and the at least two heat fins extend in the second direction from the first side to the second side, and wherein the heat radiating fins form a flow passage for fluid to flow along the second convex shape of the top surface of the heat radiating body toward the first side and toward the second side.

2. The street lamp of claim 1, wherein the heat radiating body includes a body having the heat radiating fins that extend outward from the body, and an edge portion that surrounds an outermost of the body, and wherein the edge portion comprises at least one draining hole.

3. The street lamp of claim 1, wherein the heat radiating body has a contacting part, and the street lamp further comprises a lamp post connector coupled to the contacting part of the heat radiating body.

4. A street lamp comprising:

a lamp post that includes a power supply;

a lamp post connector coupled to the lamp post and supported by the lamp post;

a light emitting diode (LED) module including a light emitting device disposed on a first side of a substrate to emit light by receiving electric power from the power supply; and a heat radiating body coupled to the lamp post connector, the heat radiating body including a convex-up top surface and a bottom surface, wherein the convex-up top surface of the heat radiating body is a hemispherical shape that is inclined from a center area toward a first side edge and is inclined from the center area toward a second side area to allow fluid to flow toward the first side edge and the second side edge of the heat radiating body, wherein the heat radiating body includes a plurality of heat radiating fins formed on the convex-up top surface of the heat radiating body and that extend outward from the convex-up top surface of the heat radiating body, and wherein the bottom surface of the heat radiating body thermally contacts a second side of the substrate.

5. The street lamp of claim 4, wherein the heat radiating body includes a contacting part, and wherein the lamp post connector comes in surface contact with the contacting part of the heat radiating body and the lamp post connector receives heat from the heat radiating body.

6. The street lamp of claim 5, wherein the contacting part of the heat radiating body includes at least one draining hole.

7. The street lamp of claim 4, further comprising a flat cover glass optically coupled to the LED module such that light generated from the LED module is irradiated to an outside of the street lamp, wherein the bottom surface of the heat radiating body includes a surface contacting part on which the LED modules are mounted, and wherein a contact surface of the surface contacting part is inclined at an acute angle with respect to the cover glass.

8. The street lamp of claim 7, wherein a plurality of the surface contacting parts are formed on the bottom surface of the heat radiating body, and wherein the plurality of the surface contacting parts have a same inclination.

9. The street lamp of claim 4, further comprising a flat cover glass optically coupled to the LED module such that light generated from the LED module is irradiated to an outside of the street lamp, wherein the LED module comprises a plurality of LEDs, and wherein the substrate is inclined at an acute angle with respect to the cover glass.

10. The street lamp of claim 4, wherein the heat radiating body includes a body having the plurality of the heat radiating fins that extend outward from the body and an edge portion that surrounds an outermost of the body, and wherein the edge portion comprises at least one draining hole.

11. The street lamp of claim 4, further comprising a heat radiating body cover covering the top surface of the heat radiating body, wherein the heat radiating body cover includes a plurality of heat radiating openings corresponding to the plurality of heat radiating fins.

12. The street lamp of claim 11, wherein the heat radiating body cover is disposed at positions lower than positions of peaks of the plurality of the heat radiating fins.

13. The street lamp of claim 11, wherein the plurality of the heat radiating openings are arranged in parallel with each other in the second direction.

14. The street lamp of claim 4, further comprising a packing disposed on the bottom surface of the heat radiating body in such a manner as to surround the LED module and prevent fluid from entering the LED module.

15. The street lamp of claim 4, wherein the lamp post comprises:

a base fixed to the ground;

a post portion being fixed and mounted on the base and including at least one flat portion; and a connector extending outward from a top surface of the post portion by a predetermined distance, and the connector being connected to the lamp post connector by being inserted within one end of the lamp post connector.

16. The street lamp of claim 15, wherein the flat portion of the post portion comprises a receiving portion formed on the flat portion of the post portion and including advertisements attached thereto.

17. A street lamp comprising:

a light emitting diode (LED) module including a plurality of LEDs disposed on one side of a substrate; and a heat radiating body having a hemispherical top surface and a bottom surface, the hemispherical top surface having a first end and a second end aligned along a first direction, and a first side and a second side aligned along a second direction transverse to the first direction, wherein the hemispherical top surface has a first convex shape from the first end to the second end, and the hemispherical top surface has a second convex shape from the first side to the second side, wherein a plurality of heat radiating fins are arranged on the hemispherical top surface and extend from the first side to the second side in the same second direction, and wherein the bottom surface is adjacent to the substrate.

18. The street lamp of claim 11, wherein the heat radiating body cover is disposed at positions higher than positions of peaks of the plurality of the heat radiating fins.

* * * * *